US011116315B2

(12) United States Patent
Hoffman

(10) Patent No.: US 11,116,315 B2
(45) Date of Patent: Sep. 14, 2021

(54) DESK HAVING MOVABLE SPLIT WORK SURFACES

(71) Applicant: Brent Hoffman, Salt Lake City, UT (US)

(72) Inventor: Brent Hoffman, Salt Lake City, UT (US)

( * ) Notice: Subject to any disclaimer, the term of this patent is extended or adjusted under 35 U.S.C. 154(b) by 0 days.

(21) Appl. No.: 16/248,116

(22) Filed: Jan. 15, 2019

(65) Prior Publication Data

US 2020/0221867 A1 Jul. 16, 2020

(51) Int. Cl.

| | |
|---|---|
| ***A47B 83/02*** | (2006.01) |
| ***A47B 13/00*** | (2006.01) |
| ***A47B 13/06*** | (2006.01) |
| ***A47B 21/04*** | (2006.01) |
| ***A47B 83/00*** | (2006.01) |
| ***A47B 13/08*** | (2006.01) |

(52) U.S. Cl.

CPC ..... *A47B 83/02* (2013.01); *A47B 13/003* (2013.01); *A47B 13/06* (2013.01); *A47B 13/081* (2013.01); *A47B 21/04* (2013.01); *A47B 83/001* (2013.01); *A47B 2013/006* (2013.01); *A47B 2083/025* (2013.01)

(58) Field of Classification Search

CPC ..... A47B 2083/025; A47B 13/081; A47B 83/001; A47B 83/02; A47B 3/14; A47B 21/04

USPC ..... 108/50.01; 297/217.3, 188, 135, 148, 297/158.2, 160, 161, 174 R, 173, 188.01

See application file for complete search history.

(56) References Cited

U.S. PATENT DOCUMENTS

| | | | | |
|---|---|---|---|---|
| 5,028,016 | A * | 7/1991 | Kelvin | B64D 11/0015 244/122 R |
| 5,315,726 | A * | 5/1994 | Borenstein | A47C 19/22 297/161 |
| 5,605,311 | A * | 2/1997 | McGrath | A47B 17/033 248/118 |
| 5,779,305 | A * | 7/1998 | Hocking | A47B 21/00 297/217.4 |
| 5,909,864 | A * | 6/1999 | Wang | A47C 7/68 248/284.1 |
| 6,092,868 | A * | 7/2000 | Wynn | A47C 7/72 297/188.05 |
| 6,102,476 | A * | 8/2000 | May | A47B 21/00 297/217.3 |
| 6,206,464 | B1 | 3/2001 | Rosa et al. | |
| 6,248,014 | B1 * | 6/2001 | Collier | A47C 7/72 454/228 |
| 6,296,408 | B1 * | 10/2001 | Larkin | A47B 83/001 400/681 |
| 6,425,631 | B1 * | 7/2002 | Lin | A47B 21/03 297/170 |
| 6,702,373 | B2 | 3/2004 | Rossko | |
| 6,776,452 | B2 | 8/2004 | Onishi | |
| 6,874,431 | B1 | 4/2005 | Danna | |

(Continued)

*Primary Examiner* — Jose V Chen

(74) *Attorney, Agent, or Firm* — Robert R. Mallinckrodt

(57) ABSTRACT

A desk for use with a chair, such as a recliner or arm chair, has desk surfaces supported on opposite sides of a front portion of the chair, with at least one of the desk surfaces movably mounted to move between a desk surface access position away from the front portion of the chair to allow access for a user to the chair and a desk surface use position with respect to the chair and a user in the chair to allow use of the desk surface for intended uses of the desk.

20 Claims, 15 Drawing Sheets

(56) References Cited

U.S. PATENT DOCUMENTS

| | | | | |
|---|---|---|---|---|
| 7,073,853 | B2 | 7/2006 | Onishi | |
| 7,134,719 | B2 * | 11/2006 | Moglin | A47C 7/72 297/217.3 |
| 7,823,973 | B2 | 11/2010 | Dragusin | |
| 7,908,978 | B1 | 3/2011 | Pelton, Jr. | |
| 8,801,638 | B2 * | 8/2014 | Gierse | A61G 5/14 297/145 |
| 9,167,906 | B2 * | 10/2015 | Dehli | A47C 7/723 |
| 9,220,348 | B2 | 12/2015 | Stieler et al. | |
| 9,433,288 | B2 * | 9/2016 | Voigt | A47C 1/0242 |
| 9,596,929 | B2 * | 3/2017 | Koulizakis | A47B 83/02 |
| 9,955,785 | B2 | 5/2018 | Voigt et al. | |
| 10,028,577 | B2 * | 7/2018 | Attouche | B25H 1/02 |
| 2001/0015567 | A1 * | 8/2001 | Tholkes | A47B 9/00 297/172 |
| 2004/0254020 | A1 * | 12/2004 | Dragusin | A47C 15/004 463/46 |
| 2006/0061150 | A1 | 3/2006 | Steenson | |
| 2006/0119233 | A1 * | 6/2006 | Thomas | A47B 21/00 312/235.9 |
| 2006/0192415 | A1 | 8/2006 | Steenson | |
| 2007/0145216 | A1 | 6/2007 | Steenson | |
| 2010/0201165 | A1 * | 8/2010 | Dankovich | A47B 83/001 297/135 |
| 2015/0289652 | A1 * | 10/2015 | Strahinic | A47B 21/0314 211/85.8 |
| 2018/0049544 | A1 | 2/2018 | Nebot | |

* cited by examiner 15
50
90
98
72
88
24
74
15
54
95
55
95
45
15
60
45
60
12
66
70
74
76
78
80
82
84
86
88
90
92
94
96
98
100
102
104
106
108
110
112
114
116
118
120
122
124
126
128
130
132
134
136
138
140
142
144
146
148
150
152

DESK HAVING MOVABLE SPLIT WORK SURFACES

BACKGROUND

Field of the Invention

The present invention relates generally to desks, and particularly to desks adapted to be positioned with respect to selected chairs such as armchairs or recliners to provide desk working surfaces to a person sitting in the selected chair.

Related Art

With the ever increasing presence of computers in the workplace and home and the increase in time a person spends in front of a computer screen and devices for interacting with the computer, both for work and entertainment, including gaming, comfort to the user and ergonomics becomes more important. For people with physical disabilities, comfort and ergonomics becomes critical. Traditional work desks and chairs often do not offer the required comfort and ergonomics. In many cases, the use of more comfortable chairs, such as armchairs and recliners, would add to the comfort of computer use. However, it is difficult or impossible to use such chairs with conventional desks and with the traditional positioning of computer input and output devices that such desks provide.

Various approaches to these problems have been suggested, such as attaching input devices such as keyboards or keyboard trays and mouse pads directly to the arms of various types of chairs having arms wherein space is provided between the arms and the chairs so that attachment can be made to an arm of the chair, see U.S. Pat. Nos. 6,206,464; 6,702,373; 9,167,906 and US Patent Application Publication Nos. 2006/0192415 and 2006/0061150; integrating keyboards or keyboard trays and mouse pads along with computer monitor mounts directly to chairs and chair supports, see U.S. Pat. Nos. 7,073,853; 7,823,973; 9,220,348; 9,955,785 and US Patent Application Publication No. 2018/0049544; and special desks configured to accept arm chairs and recliners behind the desks and to position the keyboards or keyboard trays, mouse pads, and monitors in positions with respect to the chair for a user to operate from in the chair, see U.S. Pat. Nos. 6,874,431 and 7,908,978. However, these do not provide easy relative positioning of the chairs relative to desk components and easy entry into the chairs and adjustment of the desk components relative to the chair.

There remains a need for a desk arrangement that can be positioned with respect to a large comfortable chair, such as a recliner or similar arm chair, wherein the desk can easily open to allow easy entry to or exit from the chair and allow easy adjustment of the desk surfaces and monitor mounts for comfortable location and operation of computer or gaming components.

SUMMARY OF THE INVENTION

According to the invention, desk surfaces are supported on opposite sides of a front portion of a chair, with at least one of the desk surfaces movably mounted to move between a desk surface access position away from the front portion of the chair to allow access for a user to the chair and a desk surface use position with respect to the chair and a user in the chair to allow use of the desk surface for intended uses of the desk.

In one embodiment of the desk of the invention, the desk includes a base, a first support mounted to the base, and a second support mounted to the base and spaced from the first support a distance to allow a front portion of a selected chair to be accessed between the first support and the second support. A first desk surface is movably mounted on the first support so the first desk surface can move between a first desk surface access position to allow access for a user to the chair and a first desk surface use position with respect to the chair to provide the first desk surface to be positioned with respect to the chair and a user in the chair to allow use of the first desk surface for intended uses of the desk. A second desk surface is mounted on the second support and may be mounted in a fixed second desk surface use position or may be movably mounted on the second support so the second desk surface can move between a second desk surface access position to allow access for a user to the chair and a second desk surface use position with respect to the chair to provide the second desk surface to be positioned with respect to the chair and a user in the chair to allow use of the second desk surface for intended uses of the desk. For example, both the first and second desk surfaces may be sized to extend across one half of the width of the front portion of the chair when in respective use positions with each having a confronting edge which confronts the respective confronting edge of the other respective desk surface so that the two desk surfaces, when in use positions, form a substantially continuous desk surface in front of and over the front portion of the chair. The respective confronting edges may include an attachment device to attach the confronting edges to one another to secure the respective first and second desk surfaces together to effectively form a joined single desk surface in front of and above the front portion of the chair. If desired, the respective desk surfaces may be configured with confronting end portions formed to provide an angled surface closer to the chair than the remaining portions of the respective desk surfaces to form a keyboard receiving surface positioned for appropriate keyboard operation by a user in the chair. Movement of the desk surfaces may include rotational movement and back and forth lateral movement with respect to the chair.

In addition, a computer monitor mount, such as a computer monitor mounting arm, can be secured to one or both of the respective supports or to one or both of the respective desk surfaces to adjustably mount one or more computer monitors and to position such monitors as desired by a user in the chair.

It has been found that the stability of the desk with respect to the chair used with the desk can be increased by providing a chair contact extending from each of the first and second desk surfaces to interface, when such desk surfaces are in desk surface use positions, with the arms of a chair positioned between the first support and the second support. Such chair contact may take the form of brackets extending downwardly from the respective first and second desk surfaces adapted to abut the inside surfaces of the arms of a chair when a chair having arms is positioned between the first support and the second support and the desk surfaces are moved into use positions.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiment illustrated, and specific language will be used herein to describe the same. It will nevertheless be understood that no limitation of the scope of the invention is thereby intended.

DETAILED DESCRIPTION OF EXAMPLE ILLUSTRATED EMBODIMENT

Figure 1:
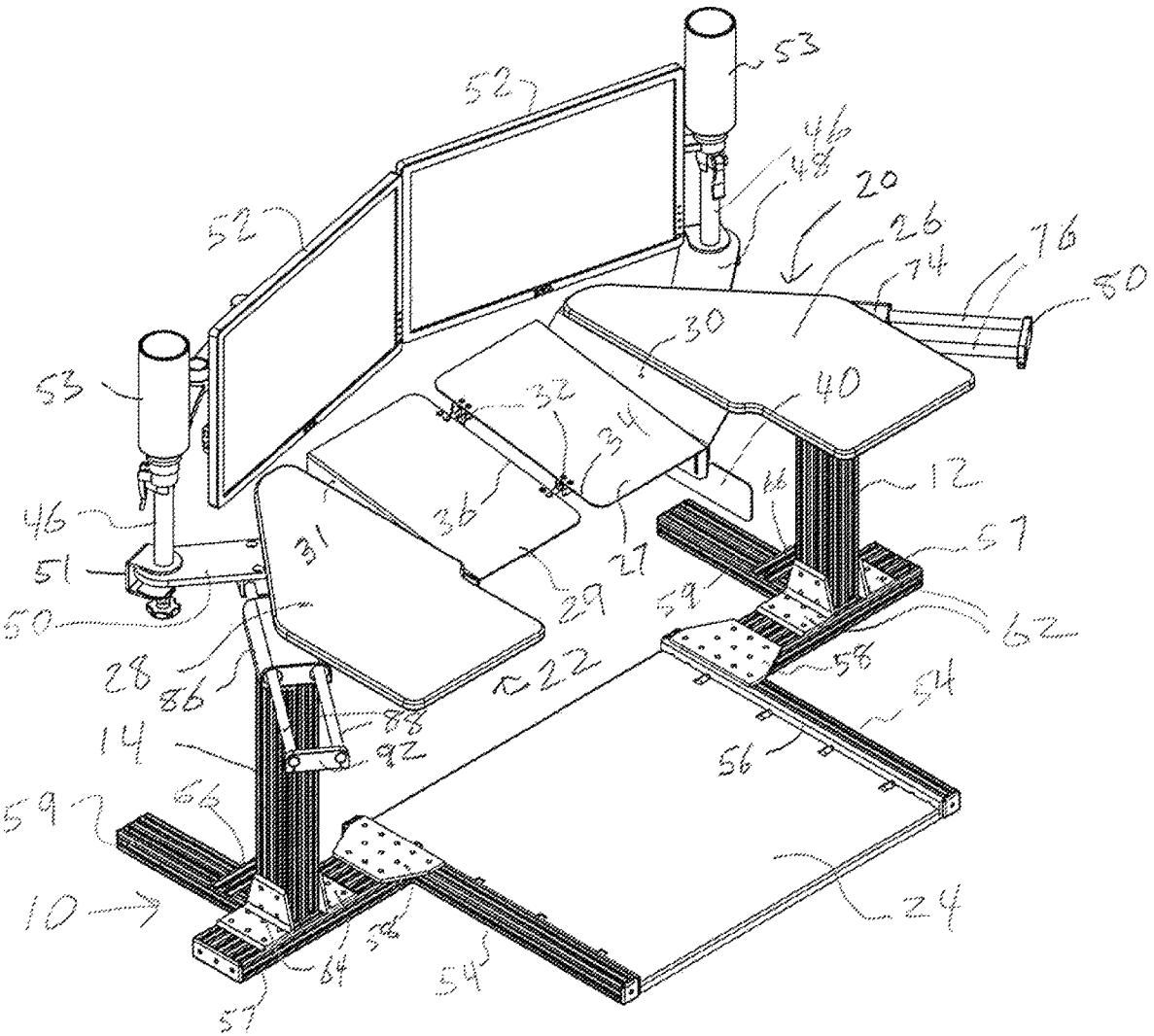
FIG. 1 is an isometric view from the top back left of the desk of the invention with the desk surfaces rotated into desk surface use positions.

The invention provides a desk for use with a chair, such as a recliner, arm chair, or any type of chair a user prefers, and includes a base 10 with a first support 12 mounted to one side of the base 10 and a second support 14 mounted to an opposite side of base 10 with the two supports spaced so that, in the illustrated embodiment, a forward portion 16 of chair 18, shown as a recliner, can be positioned between the first and second supports. While the supports are shown and described with the forward portion of the chair positioned between them, the supports could be positioned ahead of the forward portion of the chair and the chair does not have to fit between the supports. The supports merely need to be positioned so that at least one of the desk surfaces can be moved to a desk surface access position which allows access by a user to the chair without movement of the chair relative to the base. In the illustrated embodiment, the first support 12, shown on the right side of chair 18, mounts a first desk surface 20 movable between a first desk surface use position, FIGS. 1 and 2, where the first desk surface is positioned in front of and over the forward portion 16 of chair 18, FIG. 2, and a first desk surface access position, FIGS. 3 and 4, where the first desk surface is moved forwardly and to the side away from the forward portion 16 of chair 18 to thereby provide access to a user to the front portion 16 of chair 18. The second support 14, shown on the left side of chair 18, mounts a second desk surface 22, which in the embodiment illustrated, is movable between a second desk surface use position, FIGS. 1 and 2, where the second desk surface is positioned in front of and over the forward portion 16 of chair 18, FIG. 2, and a second desk surface access position, FIG. 3, where the second desk surface is moved forwardly and to the side away from the forward portion 16 of chair 18 to thereby provide increased access to a user to the front portion 16 of chair 18. In the embodiment illustrated, the base 10 can be sized and configured so that the chair 18, such as through chair base 23, is placed on a chair receiving platform portion 24 of base 10, and remains in the same position on the chair receiving platform portion 24 of base 10 during use of and nonuse of the desk. Once positioned on the chair receiving platform portion 24 of base 10, the chair does not need to be moved with respect to the desk. A user of the desk merely enters the chair or leaves the chair by moving one or both of the desk surfaces to a desk surface access position.

Figure 2:
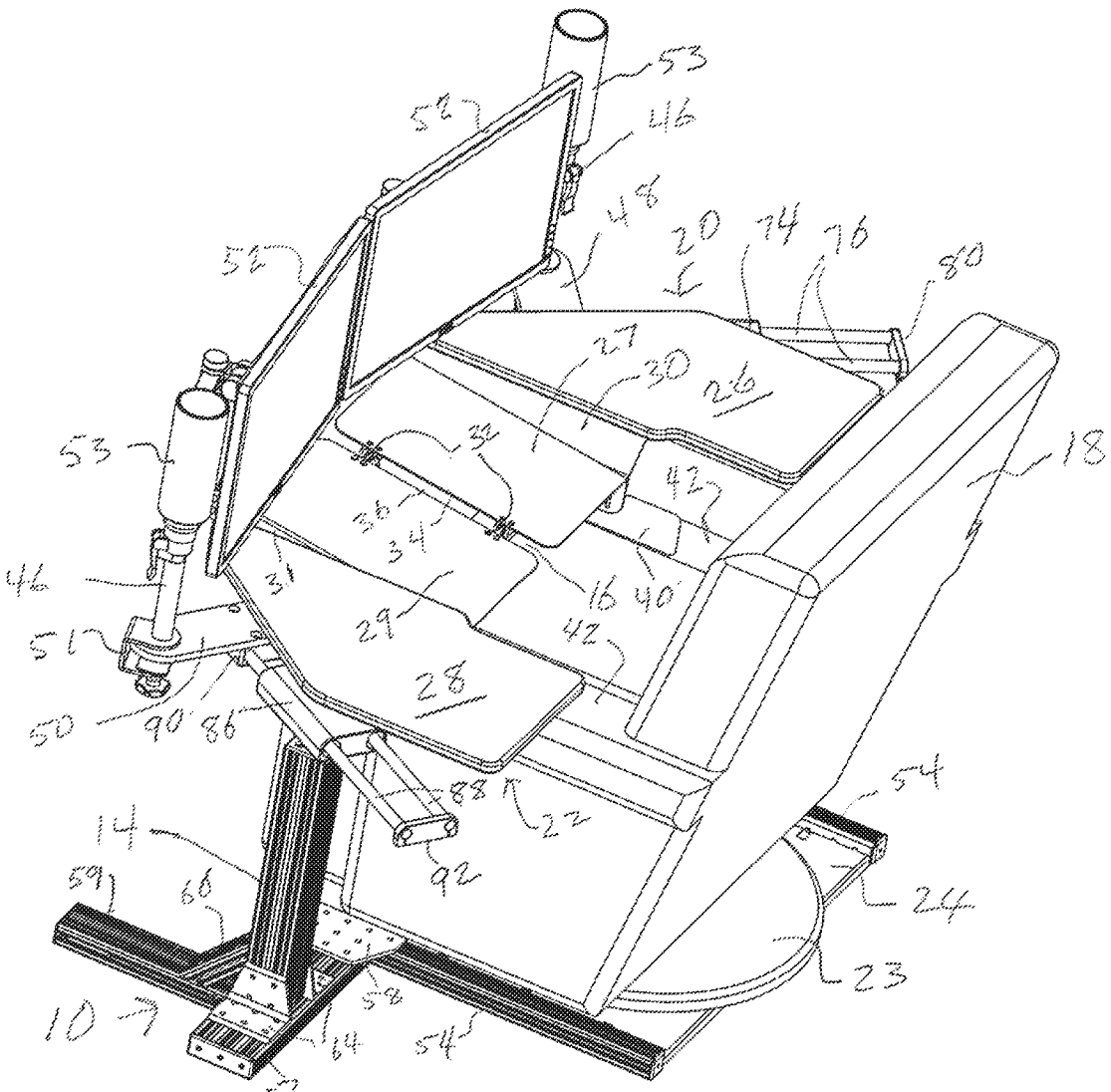
FIG. 2 is the same isometric view of the desk of the invention with the desk surfaces rotated into desk surface use positions as shown in FIG. 1, but with a chair positioned on the base with respect to the desk whereby a user can sit in the chair and use the desk.
Figure 5:
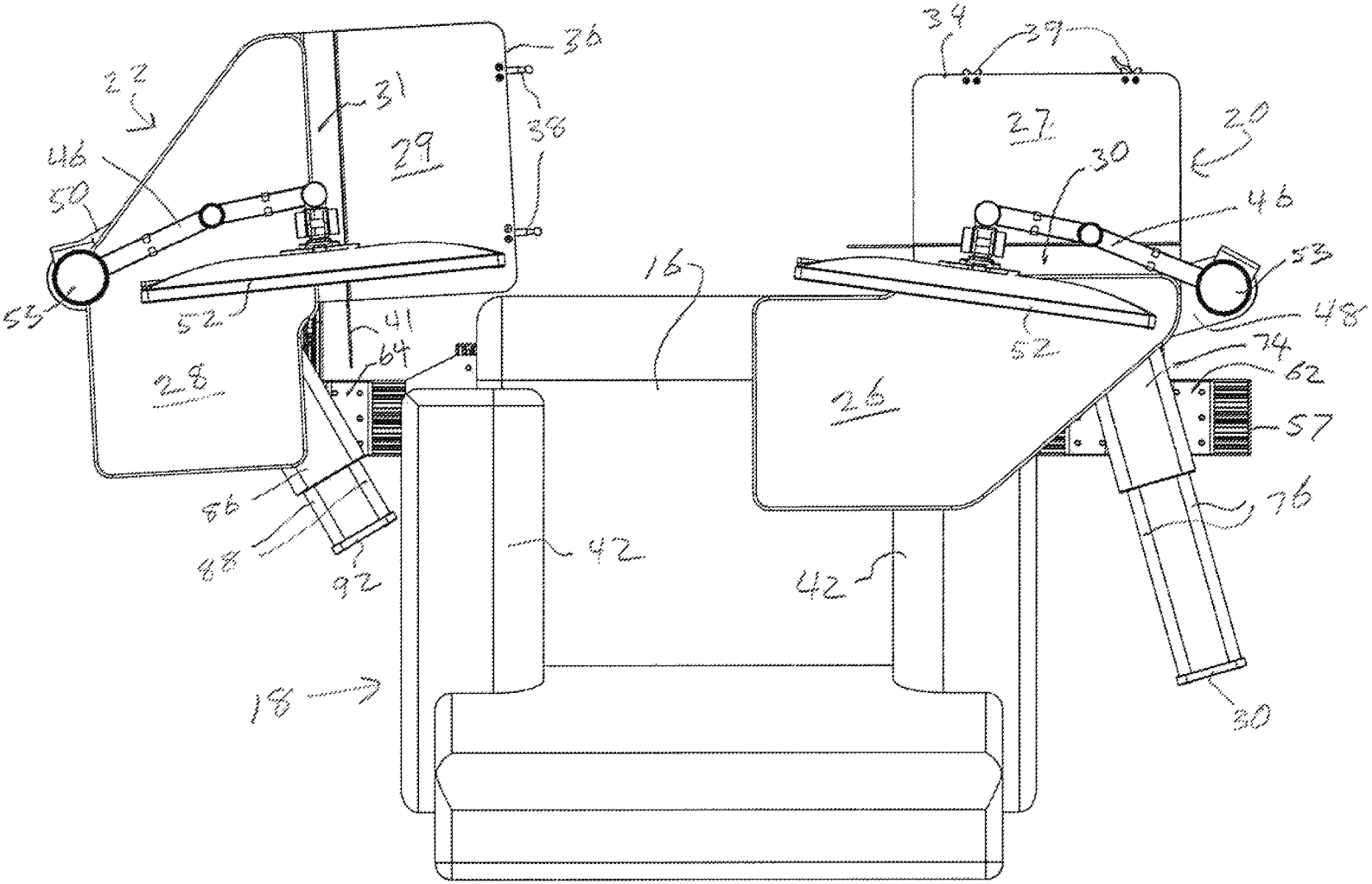
FIG. 5 is a top plan view of the desk with the desk surfaces rotated into different positions.
Figure 6:
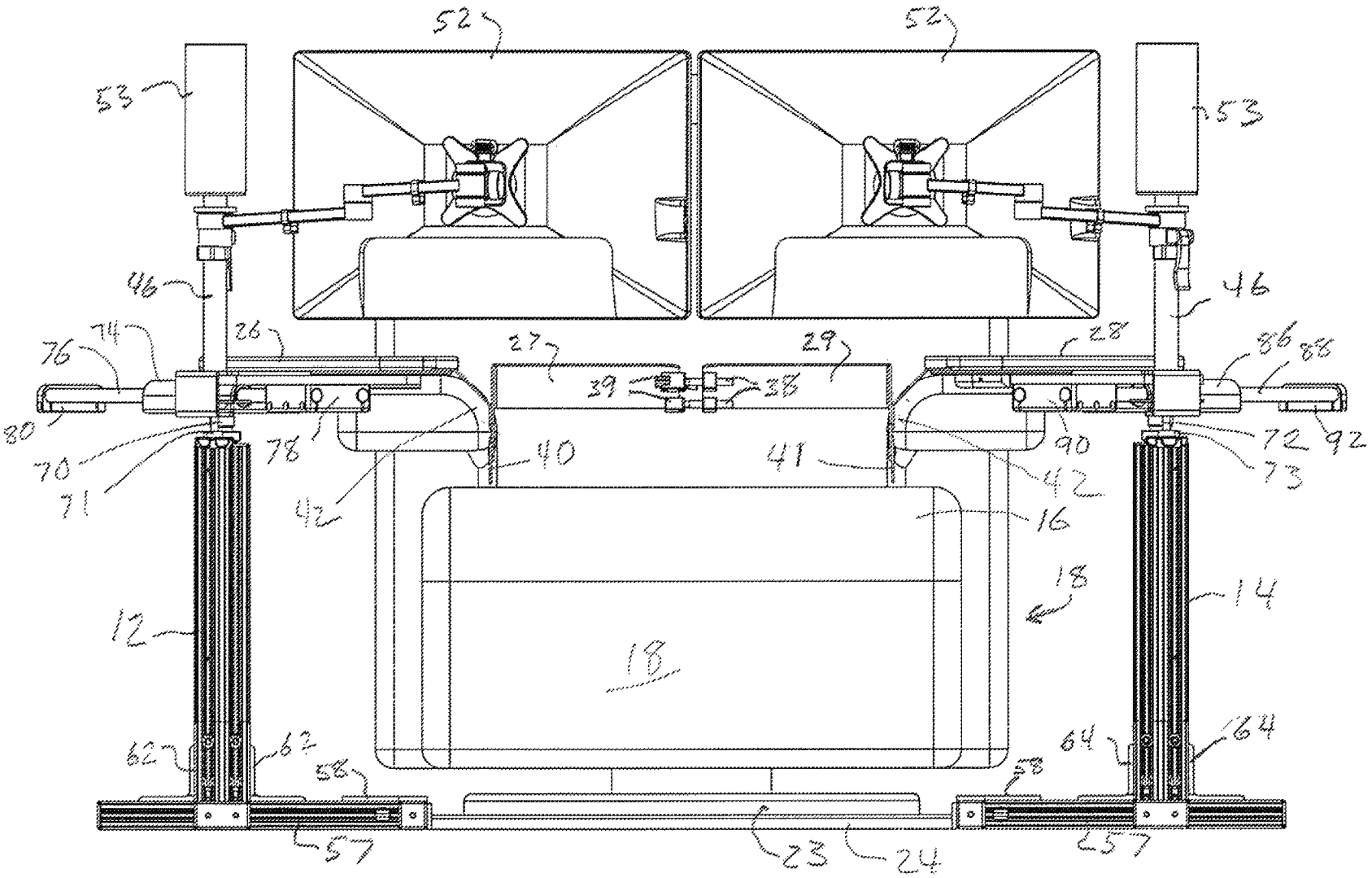
FIG. 6 is a front view of the desk and chair with the desk surfaces rotated into desk surface use positions as shown in FIG. 2.
Figure 10:
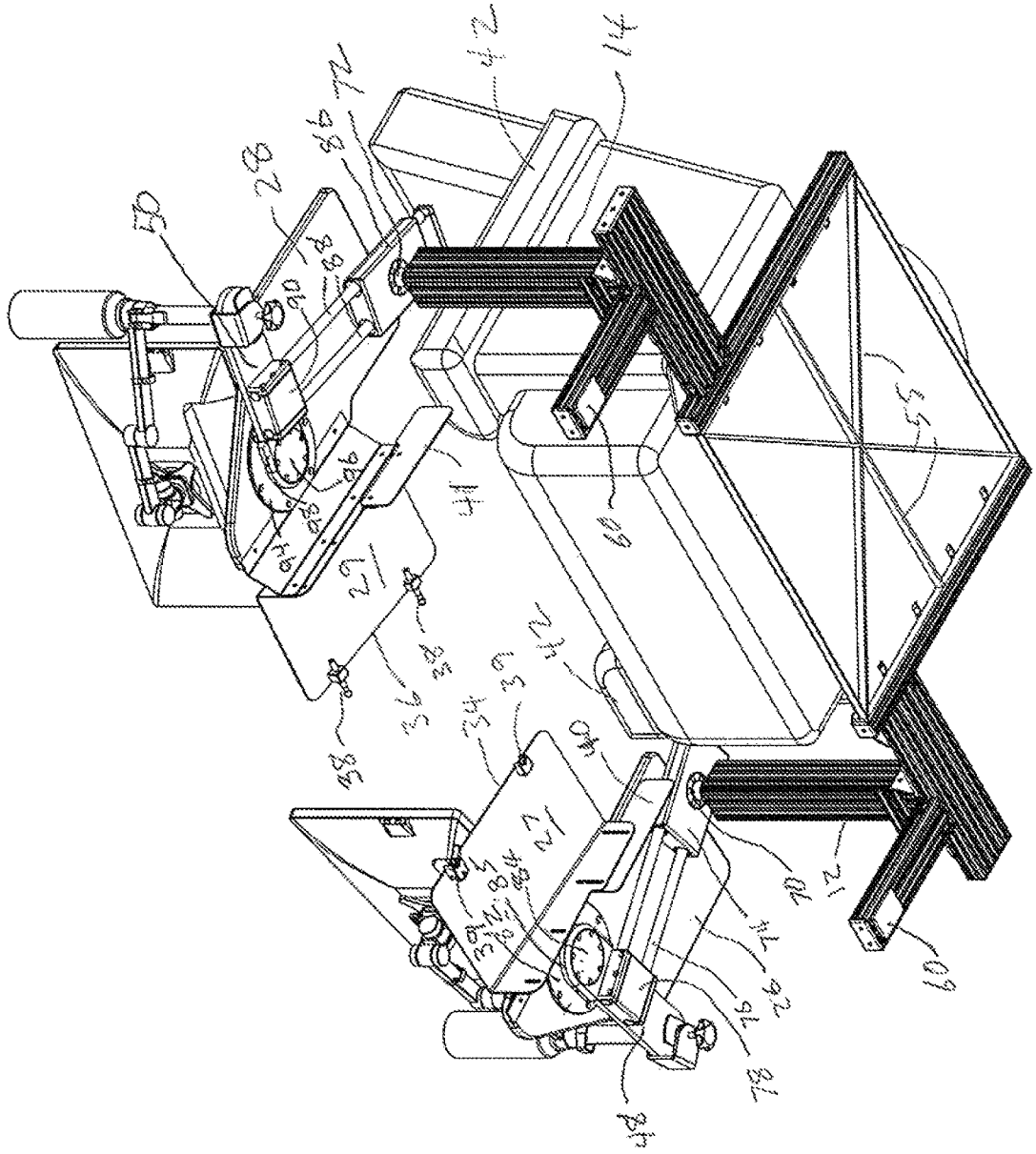
FIG. 10 is an isometric view of the desk of the invention as shown in FIG. 9 with a chair positioned on the base, but with the desk surfaces rotated into desk surface access positions to the sides of the forward portion of the chair to allow easy user access to the chair.

The desk surfaces may be configured in various ways depending upon the use to be made of the desk. In the illustrated embodiments, the first desk surface 20 includes outside flat surface portion 26 and inner offset angled portion 27, and second desk surface 22 includes outside flat surface portion 28 and inner offset angled portion 29. When the respective desk surfaces are moved to desk surface use positions shown in FIGS. 1 and 2, the inner offset angled portions 27 and 29 come together to form a work surface for positioning and supporting a computer keyboard for typing, other computer input devices for use by the user, paper for writing, or material such as magazines, books, or other documents for reading. Transition surface portions 30 and 31 extend between and attach the outside flat surface portions 26 and 28 of the first and second desk surfaces, respectively, and to the inner offset angled portions 27 and 29 of the first and second desk surfaces, respectively. Attachment devices 32 may be provided to attach the confronting edges 34 and 36 of the inner offset angled portions 27 and 29 of the respective first and second desk surfaces when in desk surface use positions. While various attachment devices can be used, FIG. 10 shows such attachment devices as comprising posts 38 extending from edge 36 and associated post receiving catches 39 positioned along edge 34. Attaching these confronting edges 34 and 36 together adds to the stability of the desk when the respective desk surfaces are each in desk surface use positions and prevents a user from inadvertently separating the respective desk surfaces when in use. In addition, chair contacts can be provided extending downwardly from the first and second desk surfaces to interface with the chair when the desk surfaces are in use position. This further stabilizes the desk and desk surfaces when the respective desk surfaces are each in use position. FIGS. 1-4, 6-8, and 10-14 show a chair contact 40 extending downwardly from the first desk surface 20 and FIGS. 2 and 6 show this chair contact 40 interfacing with a chair arm 42 of chair 18. A similar chair contact 41 extends downwardly from the second desk surface 22, hidden in FIGS. 1 and 2 by second desk surface outside flat surface portion 28 but visible in FIGS. 4-8, 10, 11, and 13, which similarly interfaces with the inside of the opposite chair arm 42, FIG. 6.

Standard monitor mounts 46 are secured to one or both of mounting arms 48 and 50, associated respectively with first desk surface 20 and second desk surface 22, to adjustably mount monitors 52 to the desk. Such standard monitor mounts 46 are shown as being of the clamp-on type to be clamped to the respective mounting arms 48 and 50, as shown, for example, at 51, FIGS. 1-3, 8-11. Speakers 53 may also be mounted to the monitor mounts 46, as can various other items such as various smart home devices or controls, and/or various other accessories. Further, while two monitor mounts 46 with two monitors 52 are shown, additional monitor mounts can be included to mount additional monitors, such as one additional monitor mount to mount one additional monitor for use with many of the current computer online games which can require three monitors. Alternately, the monitor mounts 46 shown can be monitor mounts which mount more than a single monitor. In many instances, the desk may use only a single monitor and need only a single monitor mount.

Figure 8:
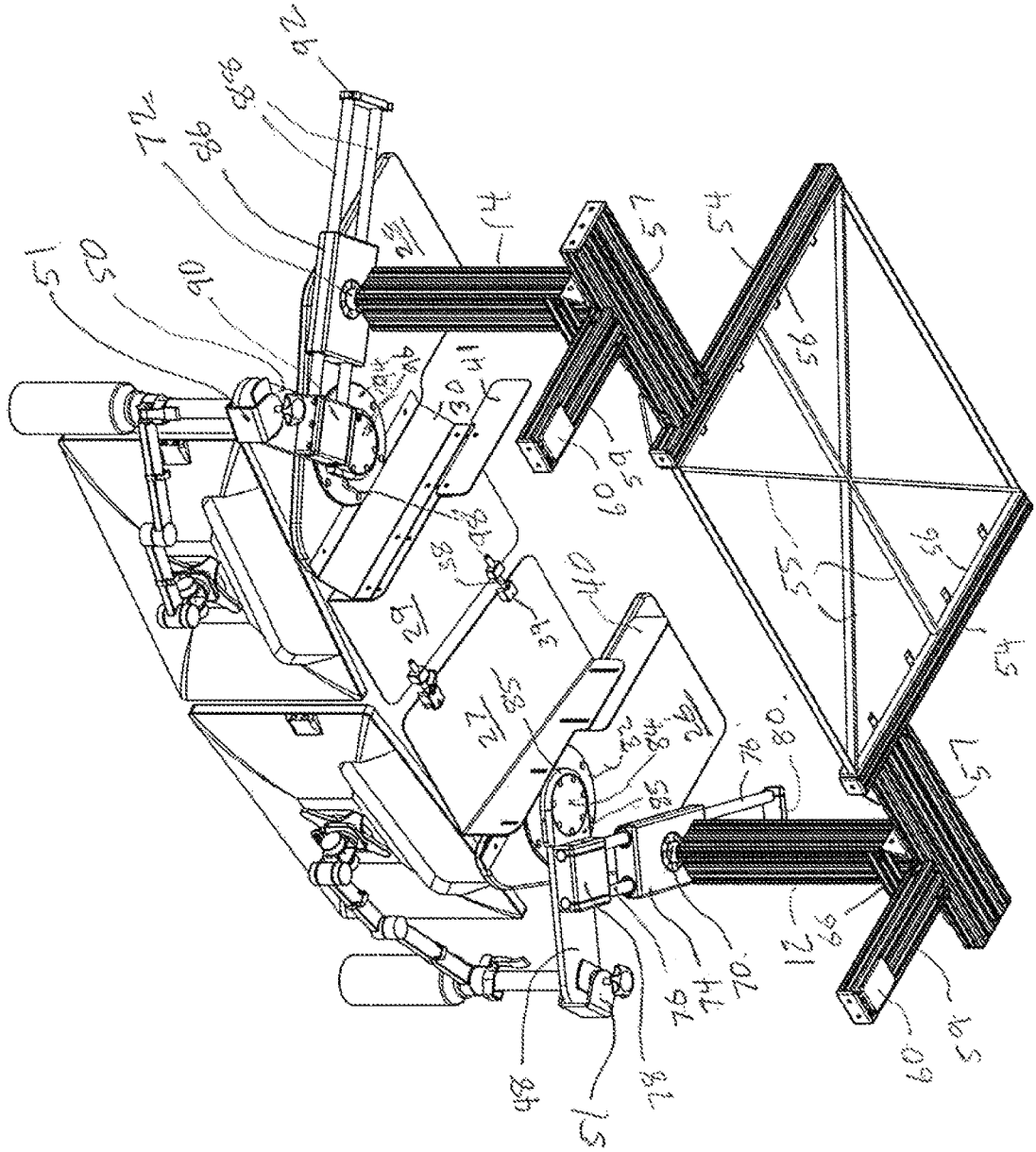
FIG. 8 is an isometric view from the bottom front left of the desk of the invention with the desk surfaces rotated into desk surface use positions.
Figure 9:
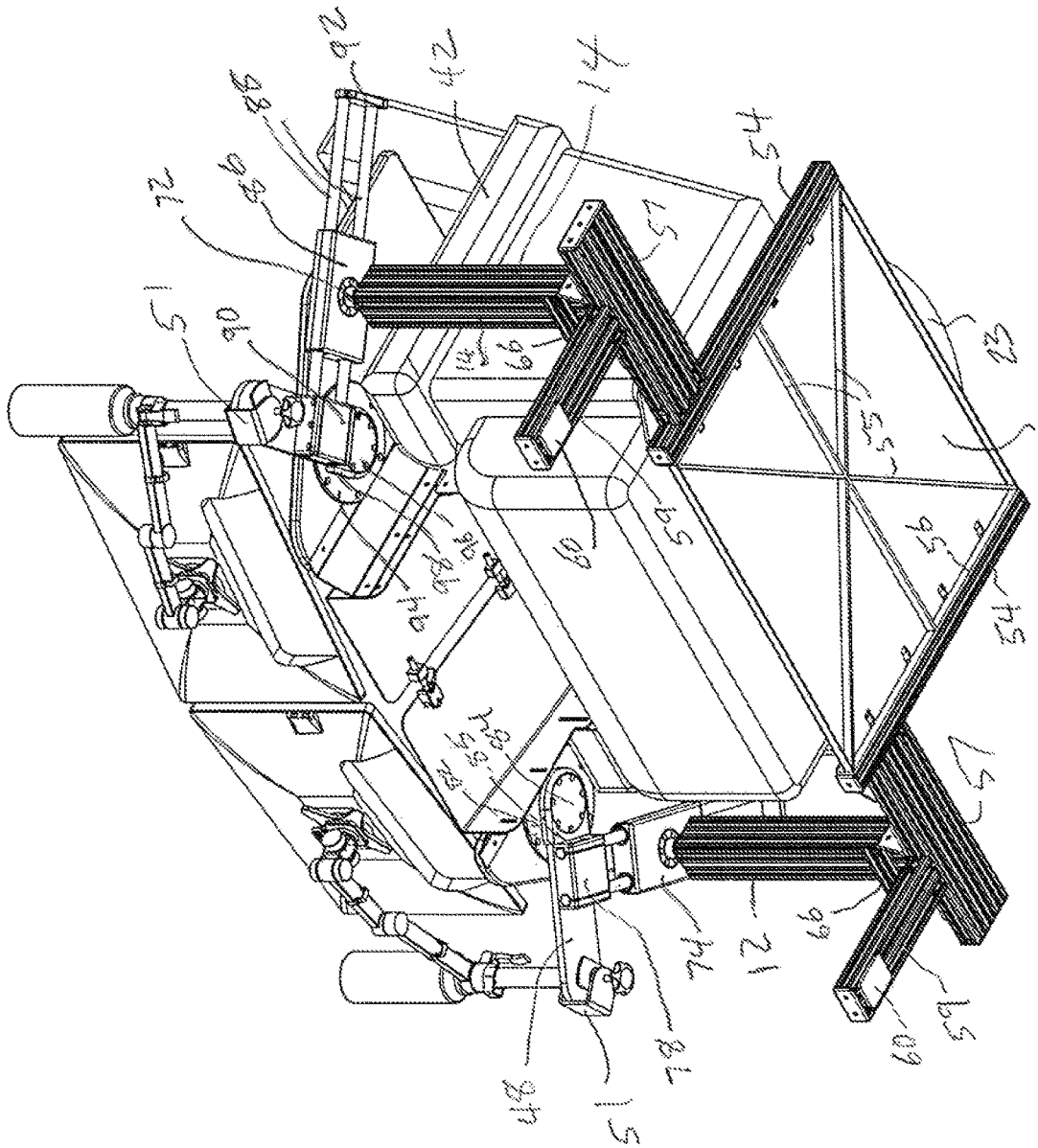
FIG. 9 is an isometric view from the bottom front left of the desk as shown in FIG. 8 with the desk surfaces rotated into desk surface use positions and showing a chair positioned on the base with respect to the desk whereby a user can sit in the chair and use the desk.

The various components of the desk can be formed and mounted together in various ways, and various desk base constructions and configurations can be used to provide supports for the desk surfaces and provide for movement of the desk surfaces such that the desk surfaces can be moved into desk surface use positions for use of the desk or to desk surface access positions to allow user access to the chair without movement of the chair. For the example embodiment illustrated, base 10 can be constructed from lengths of extruded aluminum profile bars having nut receiving "T" slots therein, such as available from 80/20 Inc. in Columbia City, Ind. Base anchor bars 54 extend along and are secured to the side edges of the chair receiving platform portion 24, which may be a steel plate that has been press braked and then reinforced with cross braces 55, FIGS. 8-10, and side plates 56 all welded together, and secured to base anchor bars 54 by bolts (not shown) extending through side plates 56 into nuts in T slots (not shown) in base anchor bars 54. Base extensions 57 are connected to base anchor bars 54 by joining plates 58 and by bolts (not shown) and bolt anchors (not shown) extending in T slots between base anchor 54 and base extension 57. Base supports 59 are connected to base extensions 57 by bolts (not shown) and bolt anchors (not shown) extending in T slots between base extensions 57 and base supports 59. Adjustable footpads 60, FIGS. 8-10, are strategically placed for leveling the base 10 and for counterbalancing any cantilever effects on the forwardly extending base supports 59. The base spaces the first support 12 and second support 14 a distance apart sufficient to allow a front portion 16 of a chair 18 desired to be used with the desk to be positioned between the first and second supports. The chair receiving surface 24, when a chair 18 is placed thereon, will tend to maintain and stabilize the relative positioning of the chair and desk. The connections of the base extensions 57 to the anchor bars 54 made with bolts and joining plates allow easy adjustment for different chair configurations or disassembly of a base extension 57 from an anchor bar 54. The first support 12 is mounted to the base extension 57 on one side of the base, shown as the right side of the base, by angle plates 62 and the second support is mounted to the base extension 57 on the opposite side of the base, shown as the left side of the base, by angle plates 64. This allows the supports to be adjusted or disconnected, if desired. An angle brace 66 can be provided between support 12 and its adjacent base support 59 and between support 14 and its adjacent base support 59, each being connected through connectors to provide rigidity to the supports in the forward and rearward directions.

Figure 7:
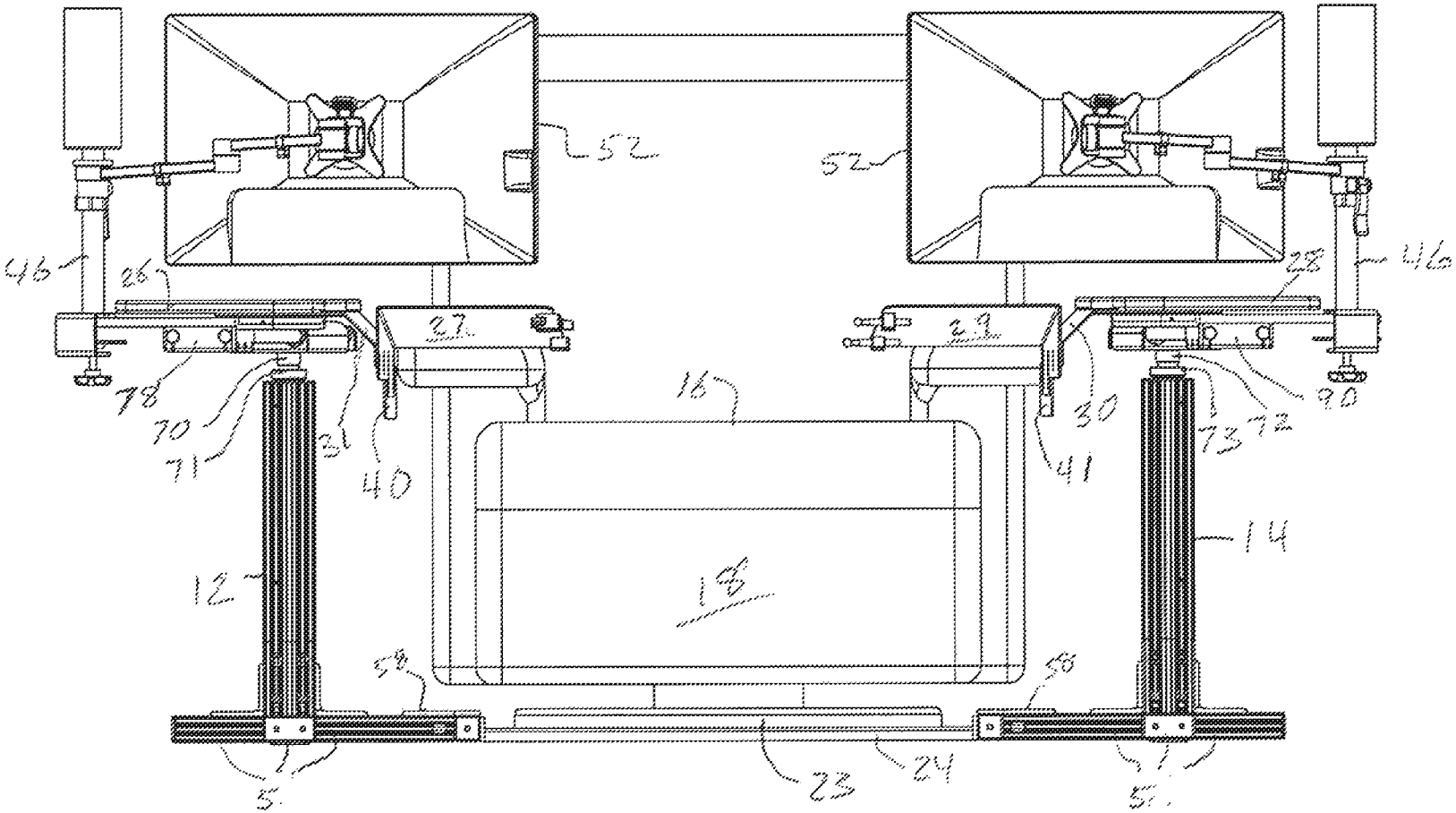
FIG. 7 is a front view of the desk and chair with the desk surfaces rotated into desk surface access positions as shown in FIG. 3.

Referring to FIGS. 6 and 7, a first rotation shaft 70 with lock collar 71 extends from the top of first support 12 and a second rotation shaft 72 with lock collar 73 extends from the top of second support 14. First rotation shaft 70 provides an axis of rotation aligned with the associated first support 12 and can be raised and lowered with respect to first support 12 and locked in vertical position by lock collar 71. This allows adjustment of the height of the top of first rotation shaft 70 which adjusts the height of the first desk surface 20. Second rotation shaft 72 provides an axis of rotation aligned with the associated second support 14 and can be raised and lowered with respect to second support 14 and locked in vertical position by lock collar 73. This allows adjustment of the height of the top of second rotation shaft 72 which adjusts the height of the second desk surface 22. A thrust bearing (not shown) may be provided between each of the lock collars 71 and 73, respectively, and the tops of supports 12 and 14, respectively, to provide easy rotation of the rotation shafts and each support may include a series of radial bushings inside (not shown) to allow easy up and down movement and easy rotation.

Figure 14:
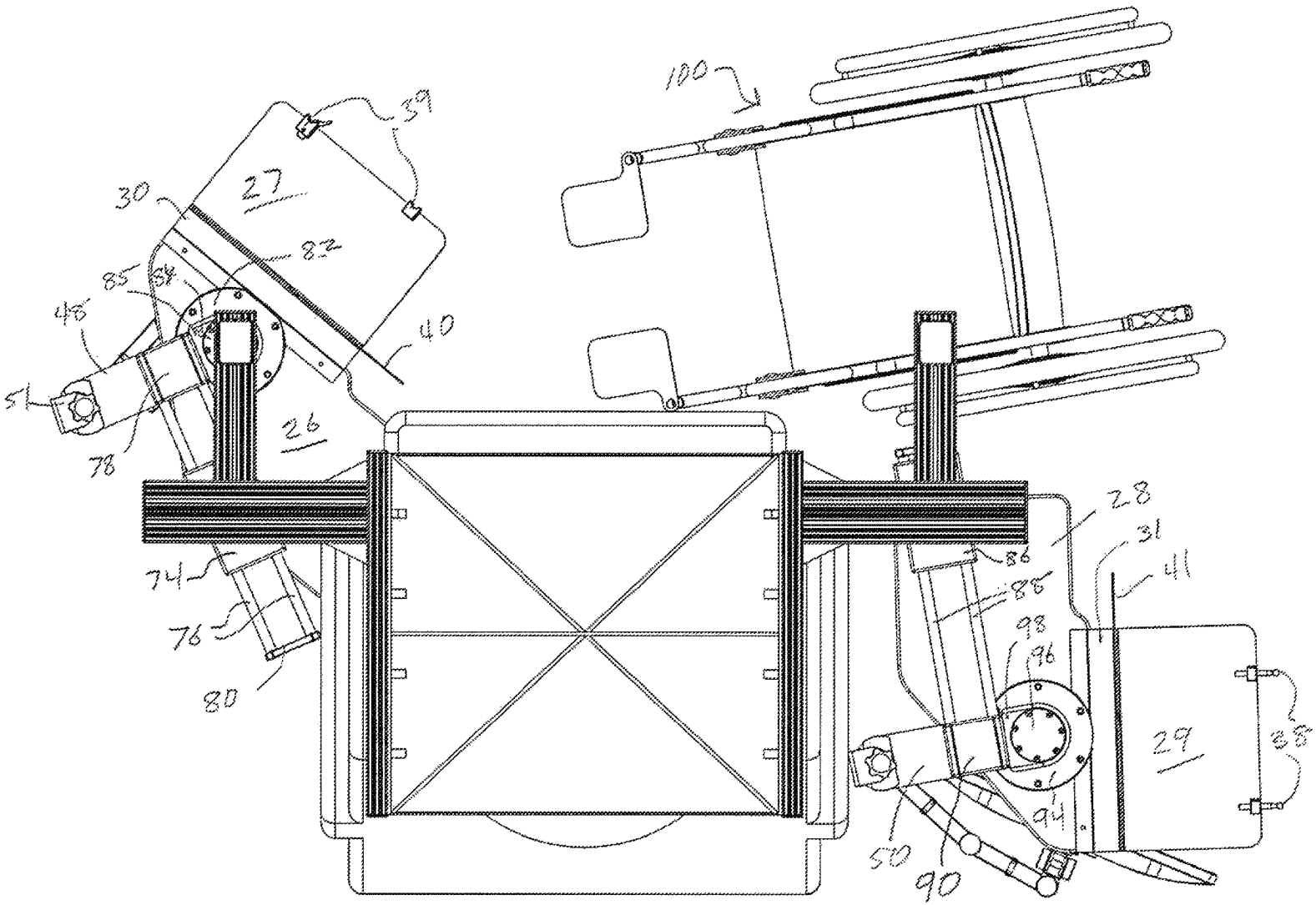
FIG. 14 is a bottom view of the desk of FIGS. 12 and 13.

Referring to FIGS. 8-11 and 14 (some details are best seen in FIG. 14), a first linear bearing housing 74, having a first pair of linear shafts 76 extending therefrom, is attached to the top of first rotation shaft 70 and can rotate with first rotation shaft 70 with respect to first support 12. The first pair of linear shafts 76 can move back and forth in the first linear bearing housing 74. One end of the first pair of linear shafts 76 are connected to a first end block 78 which is attached to a first mounting arm 48 intermediate the ends of the first mounting arm 48, to thereby rotatably attach first mounting arm 48 through the first pair of linear shafts 76, first linear bearing housing 74, and first rotation shaft 70, to first support 12. The opposite ends of the first pair of linear shafts 76 are attached to a first end connector 80. The first pair of linear shafts 76 can move back and forth in the first linear bearing housing 74 in one direction until the first end block 78 abuts one end of the first linear bearing housing 74 and in the opposite direction until the first end connector 80 abuts the opposite end of the first linear bearing housing 74. This defines a range of back and forth linear travel of the first pair of linear shafts 76, and since the first end block 78 is connected to first mounting arm 48, defines a range of back and forth linear travel of first mounting arm 48 with respect to first support 12. One end portion of first mounting arm 48 is rotatably attached to first desk surface 20 through rotating disk 82 attached to the bottom of first desk surface 20 and rotation ball bearing housing 84 attached to the end portion of first mounting arm 48. This allows rotation of first desk surface 20 with respect to first mounting arm 48. Thus, in the illustrated embodiment, first desk surface 20 has two axes of rotation, i.e., a first axis of rotation through first mounting arm 48 about first rotation shaft 70 and a second axis of rotation with respect to first mounting arm 48 created by rotating disk 82 and rotation ball bearing housing 84. First desk surface 20 also has a range of linear back and forth travel provided by back and forth movement of the first pair of linear shafts 76 in first linear bearing housing 74. First desk surface 20 can therefore rotate with respect to first support 12 and with respect to its associated first mounting arm 48, and can also move back and forth with respect to its first support 12. This provides a wide range of movement of first desk surface 20 with respect to first support 12 and with respect to chair 18. Further, if ball bearing attachment is provided as described for the illustrated embodiment, such movement can be very easily produced by the user. However, satisfactory operation and movement of a desk surface can be achieved through various other rotational and sliding attachments. With the illustrated configuration, a filler piece 85 is attached to first mounting arm 48 around rotation ball bearing housing 84 and between the rotation ball bearing housing 84 and the first end block 78 to fill the space therebetween and make it level with the bottom of rotation ball bearing housing 84 and to provide a smooth surface extending down from the bottom of first mounting arm 48 around rotation ball bearing housing 84 to allow a smooth transition if or when a chair arm 42 comes in contact with rotation ball bearing housing 84. Filler piece 85 forms a smooth surface around the edge of the rotation ball bearing housing 84 to prevent the arm of a chair from getting damaged by the edge of rotation ball bearing housing 84 or from getting lodged and stuck between the rotation ball bearing housing 84 and the first end block 78.

Similarly, in the embodiment show, as indicated, a second rotation shaft 72 extends from the top of second support 14. Second rotation shaft 72 provides an axis of rotation aligned with the associated second support 14. A second linear bearing housing 86, having a second pair of linear shafts 88 extending therefrom, is attached to the top of second rotation shaft 72 and can rotate with respect to second support 14. The second pair of linear shafts 88 can move back and forth in the second linear bearing housing 86. One end of the second pair of linear shafts 88 are connected to a second end block 90 which is attached to a second mounting arm 50 intermediate the ends of second mounting arm 50, to thereby rotatably attach second mounting arm 50 through the second pair of linear shafts 88, second linear bearing housing 86, and second rotation shaft 72, to second support 14. The opposite ends of the second pair of linear shafts 88 are attached to a second end connector 92. The second pair of linear shafts 88 can move back and forth in the second linear bearing housing 86 in one direction until the second end block 90 abuts one end of the second linear bearing housing 86, and in the opposite direction until the second end connector 92 abuts the opposite end of the second linear bearing housing 86. This defines a range of back and forth linear travel of the second pair of linear shafts 88, and since the second end block 90 is connected to second mounting arm 50, defines a range of back and forth linear travel of second mounting arm 50 with respect to second support 14. One end portion of second mounting arm 50 is rotatably attached to second desk surface 22 through rotating disk 94 attached to the bottom of second desk surface 22 and rotation ball bearing housing 96 attached to the end portion of second mounting arm 50. This allows rotation of second desk surface 22 with respect to second mounting arm 50. Thus, in the illustrated embodiment, second desk surface 22 also has two axes of rotation, i.e., a first axis of rotation through second mounting arm 50 about second rotation shaft 72 and a second axis of rotation with respect to second mounting arm 50 created by rotating disk 94 and rotation ball bearing housing 96. Second desk surface 22 also has a range of linear back and forth travel provided by back and forth movement of the second pair of linear shafts 88 in second linear bearing housing 86. Second desk surface 22 can therefore rotate with respect to its second support 14 and with respect to its associated second mounting arm 50, and can also move back and forth with respect to its second support 14. This provides a wide range of movement of second desk surface 22 with respect to second support 14 and with respect to chair 18. With the illustrated configuration, a filler piece 98 is attached to second mounting arm 50 around rotation ball bearing housing 96 and between the rotation ball bearing housing 96 and the second end block 90 to fill the space therebetween and make it level with the bottom of rotation ball bearing housing 96 and to provide a smooth surface extending down from the bottom of second mounting arm 50 around rotation ball bearing housing 96 to allow a smooth transition if or when a chair arm 42 comes in contact with rotation ball bearing housing 96. Filler piece 98 forms a smooth surface around the edge of the rotation ball bearing housing 96 to prevent the arm of a chair from getting damaged by the edge of rotation ball bearing housing 96 or from getting lodged and stuck between the rotation ball bearing housing 96 and the second end block 90.

Operation of the illustrated embodiment of the desk can be seen from comparison of several of the drawings. FIGS. 1, 2, 6, 8, and 9 show the desk with the first and second desk surfaces 20 and 22 both in desk surface use position wherein the desk surfaces are rotated toward one another and moved longitudinally toward the chair so that their confronting edges 34 and 36 come together and the closed desk surfaces are in a position for use by a user sitting in or reclining in the chair. It can be seen from FIGS. 1, 2, 8, and 9 that, in this position, the desk surfaces have been moved longitudinally back toward the chair as the first and second pairs of linear shafts 76 and 88, respectively, have most of their length extending behind the first and second linear bearing housings 74 and 86. However, the desk surfaces joined together in desk surface use positions shown, can be moved forwardly away from the chair or backwardly toward the chair over a range of longitudinal travel so a user can position such joined together desk surfaces in a comfortable position for use in relation to the user sitting in the chair.

FIGS. 3, 4, 7, and 10 show the desk with the first and second desk surfaces 20 and 22 both in desk surface access position wherein the desk surfaces are rotated away from one another and moved longitudinally away from the chair so there is an opening between the respective desk surfaces to allow a user to easily enter the chair or leave the chair. It can be seen from FIGS. 3, 4, 7, and 10 that in this position shown, the desk surfaces have been rotated with respect to the first and second supports 12 and 14 (compare the angle of first linear bearing housing 74 to first support 12, and second linear bearing housing 86 to the second support 14 in use position, FIGS. 1, 8, and 9, to the angle of first linear bearing housing 74 to first support 12, and second linear bearing housing 86 to the second support 14, in access position, FIGS. 3, 4, and 10) and that the desk surfaces have been moved longitudinally forward away from the front portion of the chair as the linear shafts of the first and second pairs of linear shafts 76 and 88 have most of their length extending ahead of the first and second linear bearing housings 74 and 86 and very little of their length extending behind the first and second linear bearing housings 74 and 86. While a desk surface access position allowing access to the chair can be achieved in various ways, such as by merely rotating the respective desk surfaces, or in some cases by merely rotating one of the respective desk surfaces, to the side of the chair without longitudinal movement forwardly away from the front portion of the chair, it will generally be desirable to move the desk surfaces to the desk surface access positions by a combination of both rotational movement toward the side of the chair and longitudinal movement forwardly away from the front portion of the chair.

Figure 3:
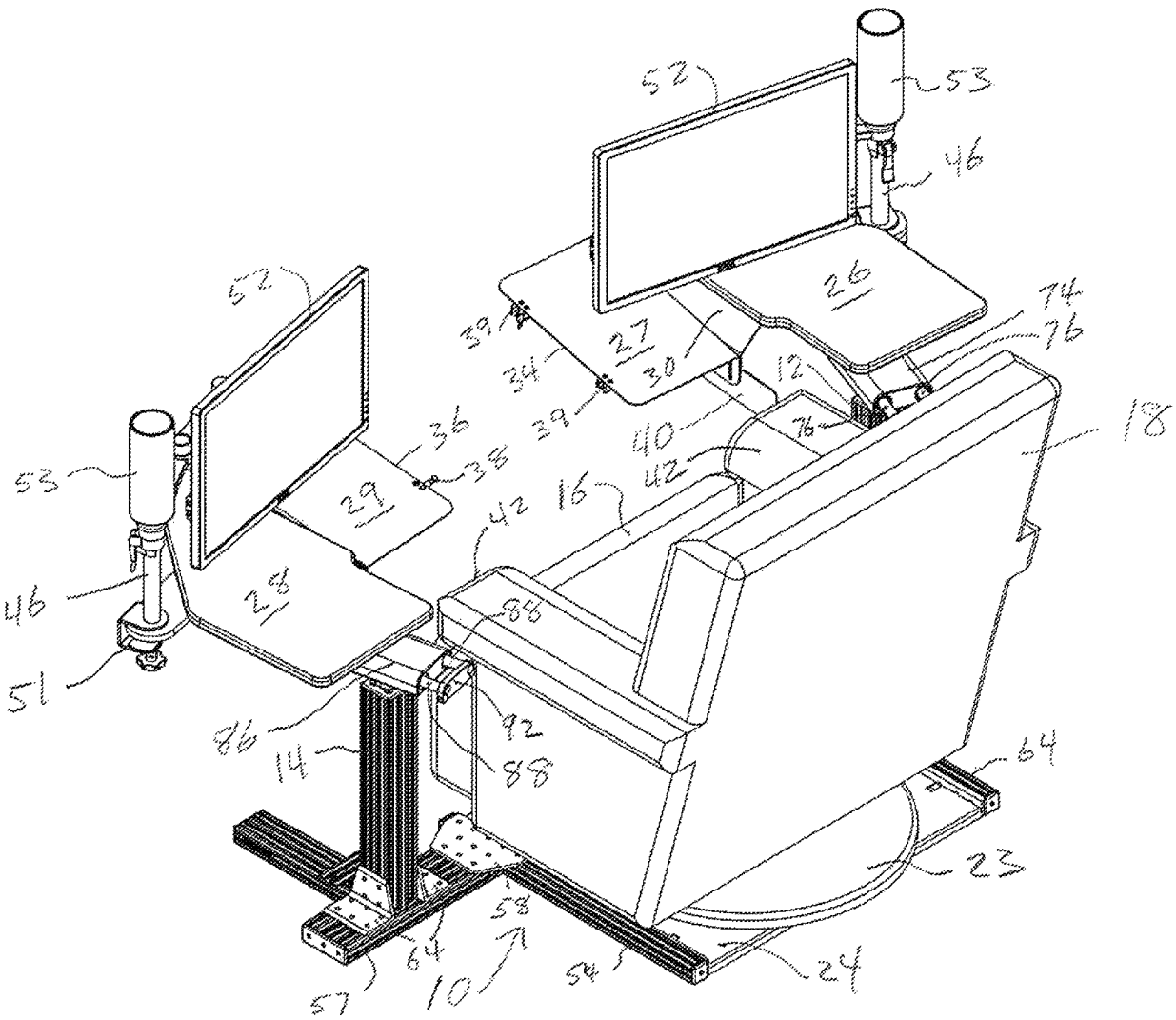
FIG. 3 is an isometric view of the desk of the invention with a chair positioned on the base as shown in FIG. 2, but with the desk surfaces rotated into desk surface access positions to the sides of the forward portion of the chair to allow easy user access to the chair.
Figure 4:
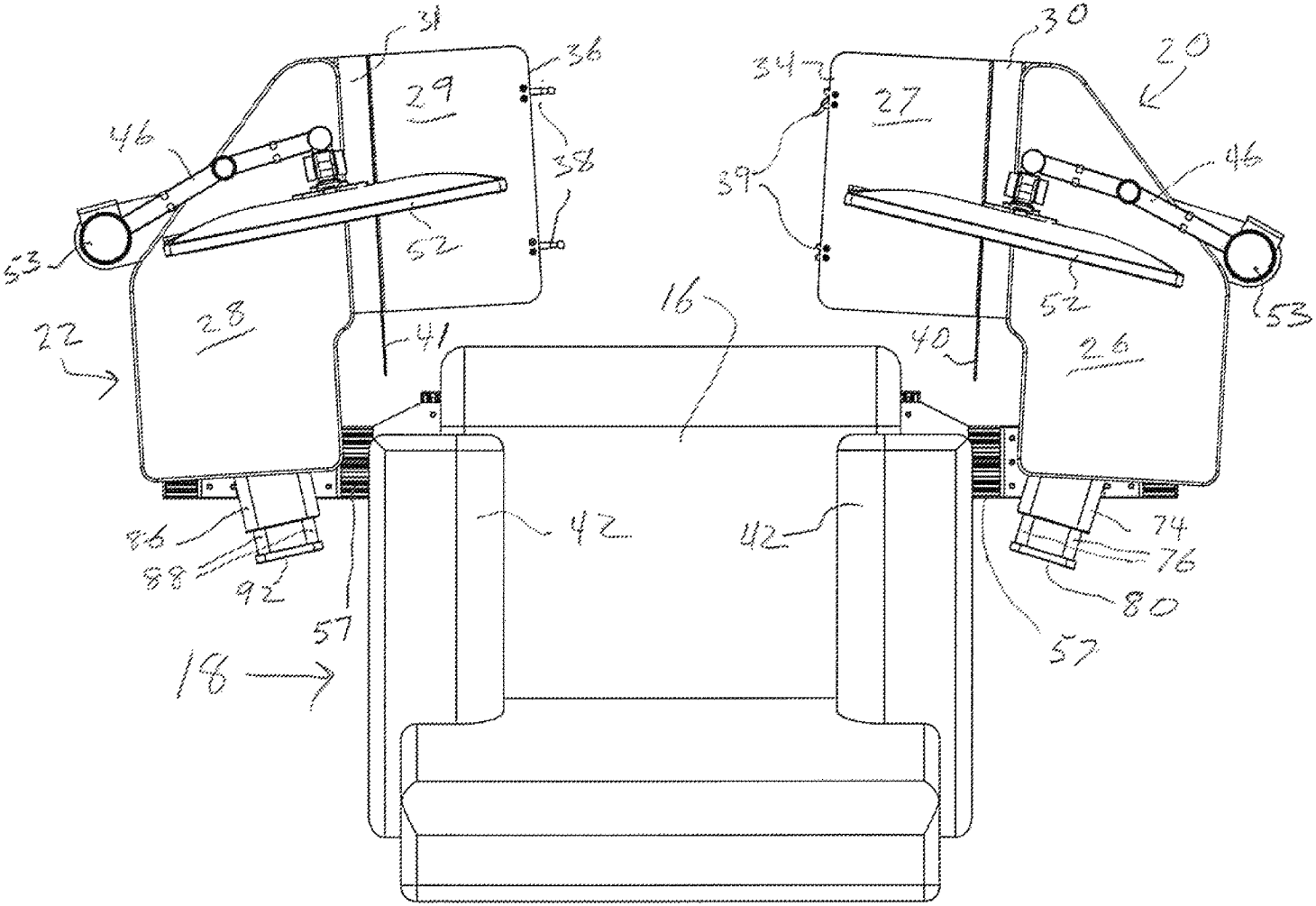
FIG. 4 is a top plan view of the desk of FIG. 3 showing the desk surfaces rotated into desk surface access positions as in FIG. 3.
Figure 11:
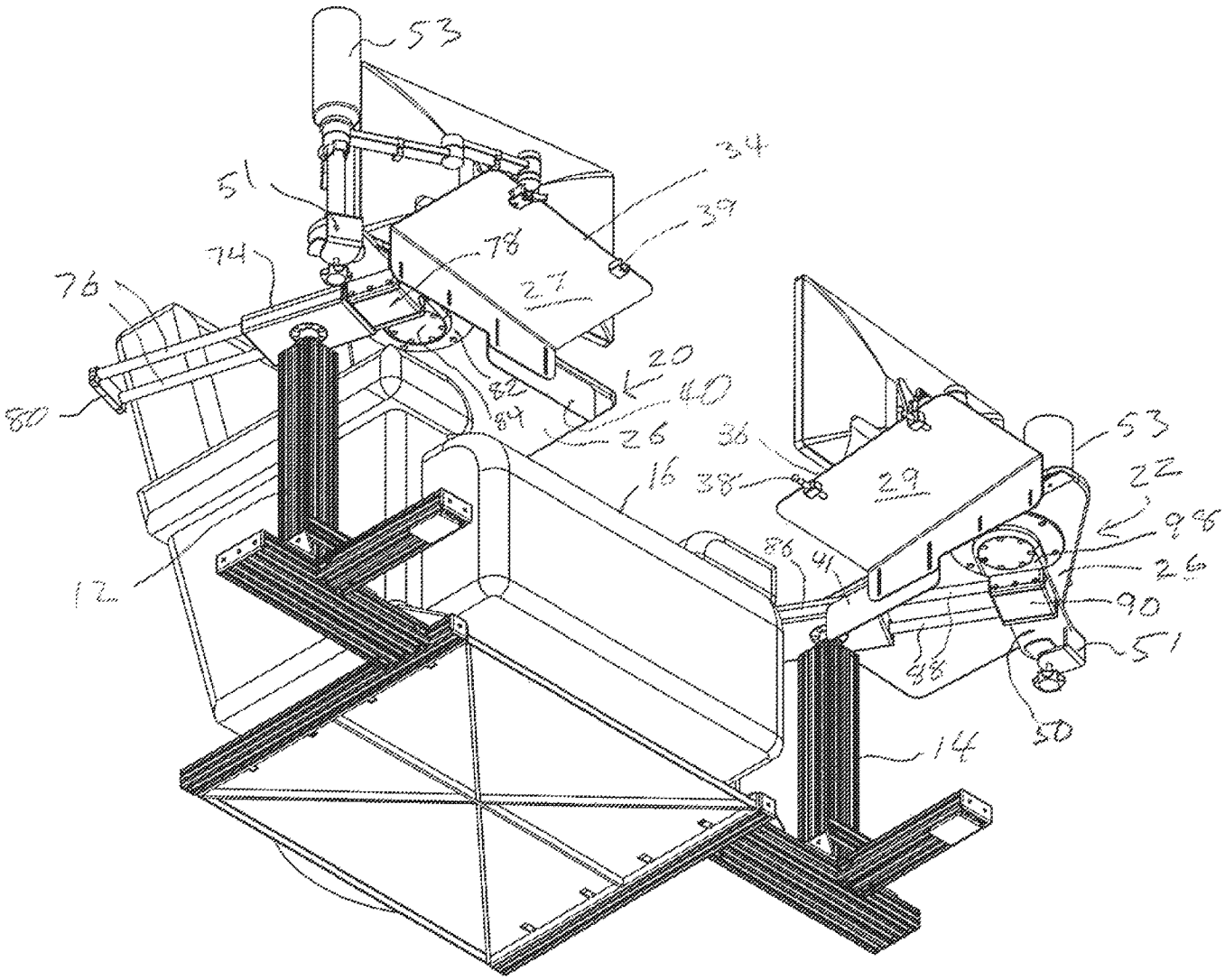
FIG. 11 is an isometric view from the bottom front right of the desk of the invention with a chair positioned on the base, and with the desk surfaces rotated into positions as shown in FIG. 5.

Since both the first and second desk surfaces move independently, each desk surface can be independently moved to various different positions. FIGS. 5 and 11 show the desk with the first desk surface 20 rotated ninety degrees with respect to first support 12 so that first desk surface inner offset angled portion 28 is rotated so that confronting edge 34 is facing forwardly with respect to the chair 18 and first desk surface outside support surface 26 is rotated over chair arm 42 and chair forward portion 16 and is pulled back longitudinally as far as possible over chair arm 42 and chair forward portion 16 (see FIG. 11 showing first end connector 80 abutting the front of first linear bearing housing 74 and the length of linear shafts 76 extending from the back of first linear bearing housing 74). In this position, the first desk surface outside flat support surface 26 is positioned with respect to chair 18 so that a user in chair 18 can work on first desk surface outside flat support surface 26 which is now over the right forward portion of the chair. FIGS. 5 and 11 show the second desk surface moved to an access position to the left side of chair 18 and not quite as far forward as shown in FIGS. 3, 4, and 10.

Figure 12:
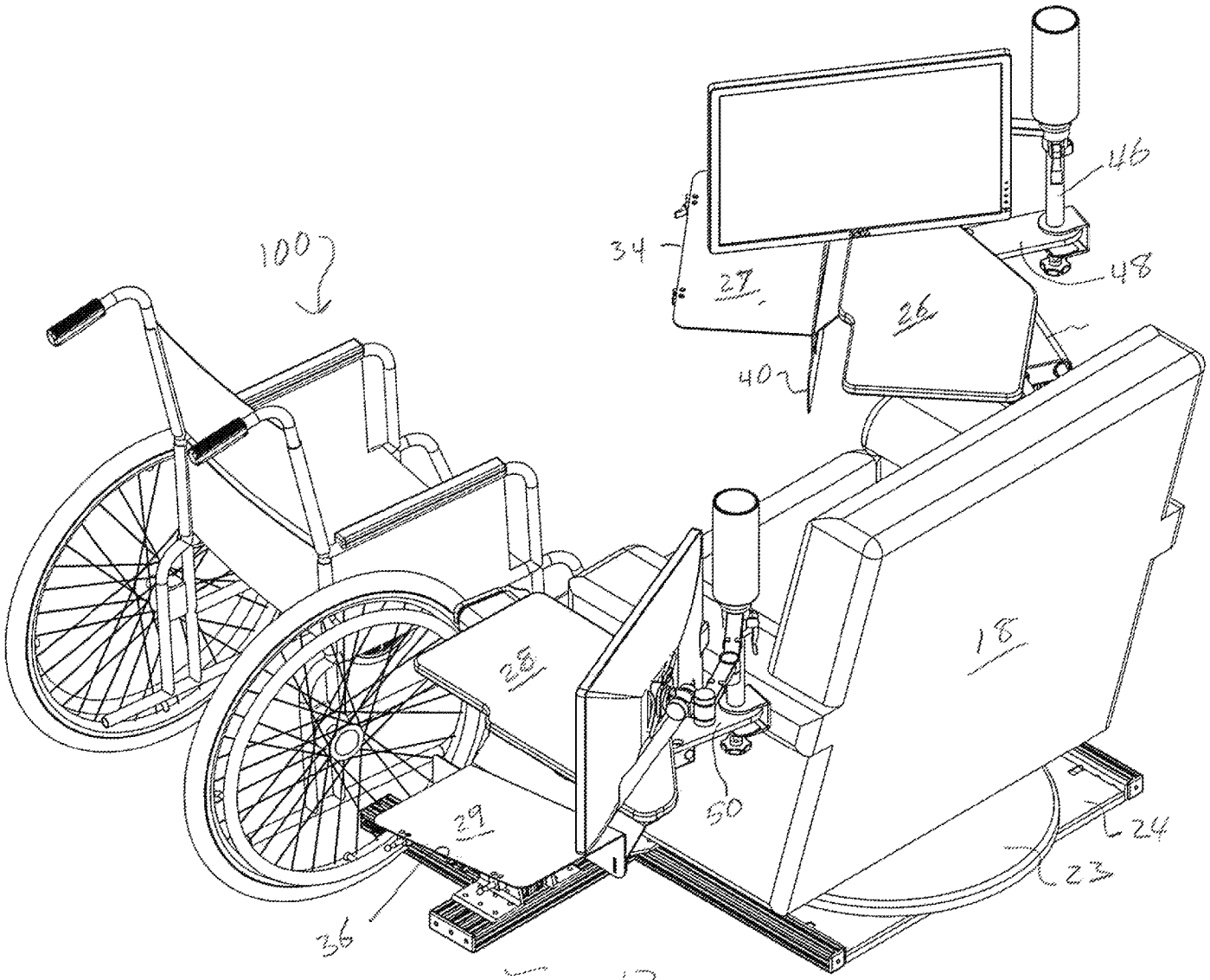
FIG. 12 is an isometric view of the desk of the invention with a chair positioned on the base as shown in FIG. 3, but with the desk surfaces rotated into different desk surface positions adapted to provide access for a user from a wheelchair into the chair.
Figure 13:
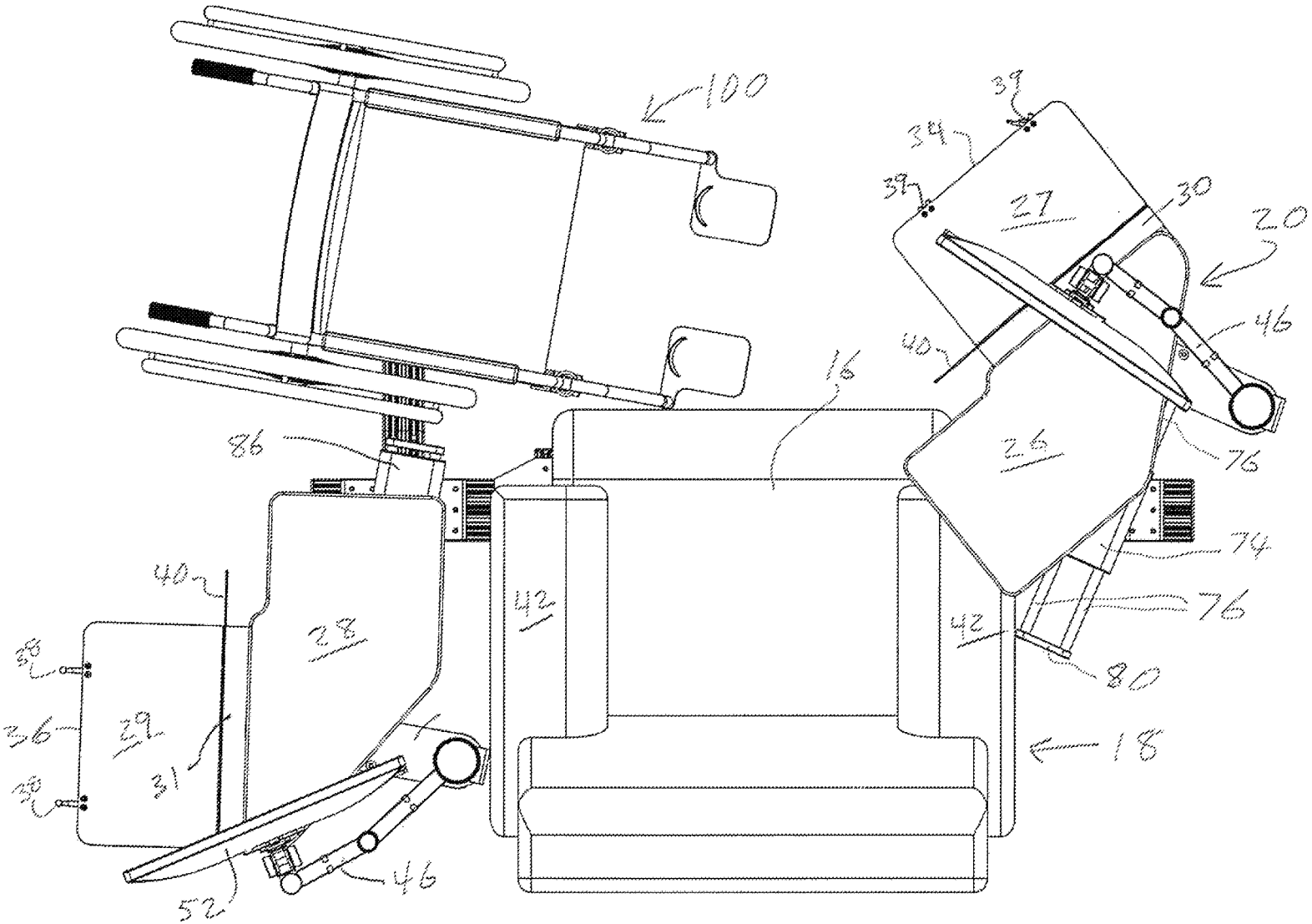
FIG. 13 is a top plan view of the desk of FIG. 12 showing the desk surfaces rotated into desk surface access positions as in FIG. 12.

FIGS. 12-14 show the first and second desk surfaces moved to an additional position which can allow wheelchair access to the chair 18. As shown, the first desk surface 20 is moved to a different access position than shown in FIGS. 3, 4, and 10 with first desk surface 20 rotated to an approximate forty five degree rotated position with respect to chair 18 and drawn longitudinally somewhat closer to the chair 18. The second desk surface 22 is rotated one hundred and eighty degrees with respect to chair 18 so that second desk surface inner offset angled portion 28 is rotated so that confronting edge 36 is facing outwardly to the left side of chair 18 and second desk surface outside support surface 26 is displaced sideways from left chair arm 42 and is pulled back longitudinally as far as possible so is completely behind the front of the left arm 42 of chair 18. This allows a wheelchair 100 to be positioned in front of the left side of chair 18, as shown, to enable a person in wheelchair 100 to move from wheelchair 100 into chair 18. The desk surfaces could easily be moved oppositely to that shown to allow a wheelchair 100 to be similarly positioned in front of the right side of chair 18.

As can be seen, with the provision of the two axes of rotation and the back and forth linear movement for each of the two desk surfaces (three degrees of movement for each desk surface) as shown for the illustrated embodiment, the desk surfaces can be positioned in a wide variety of both access and use positions to meet the needs of almost any user. However, provision of less than the three degrees of movement can still provide a desk that can be positioned with respect to a desired chair to provide both use positions and access positions. For example, provision of about ninety degrees of rotation for one or both of the desk surfaces with respect to the associated support can provide a desk with satisfactory use and access positions of the desk surfaces or of one of the desk surfaces for most chairs and users. Similarly, provision of lateral movement in a single direction with respect to the associated support, such as movement toward or away from a side of the chair, can also provide a desk with satisfactory use and access positions of the desk surfaces or of one of the desk surfaces for most chairs and users.

Figure 15:
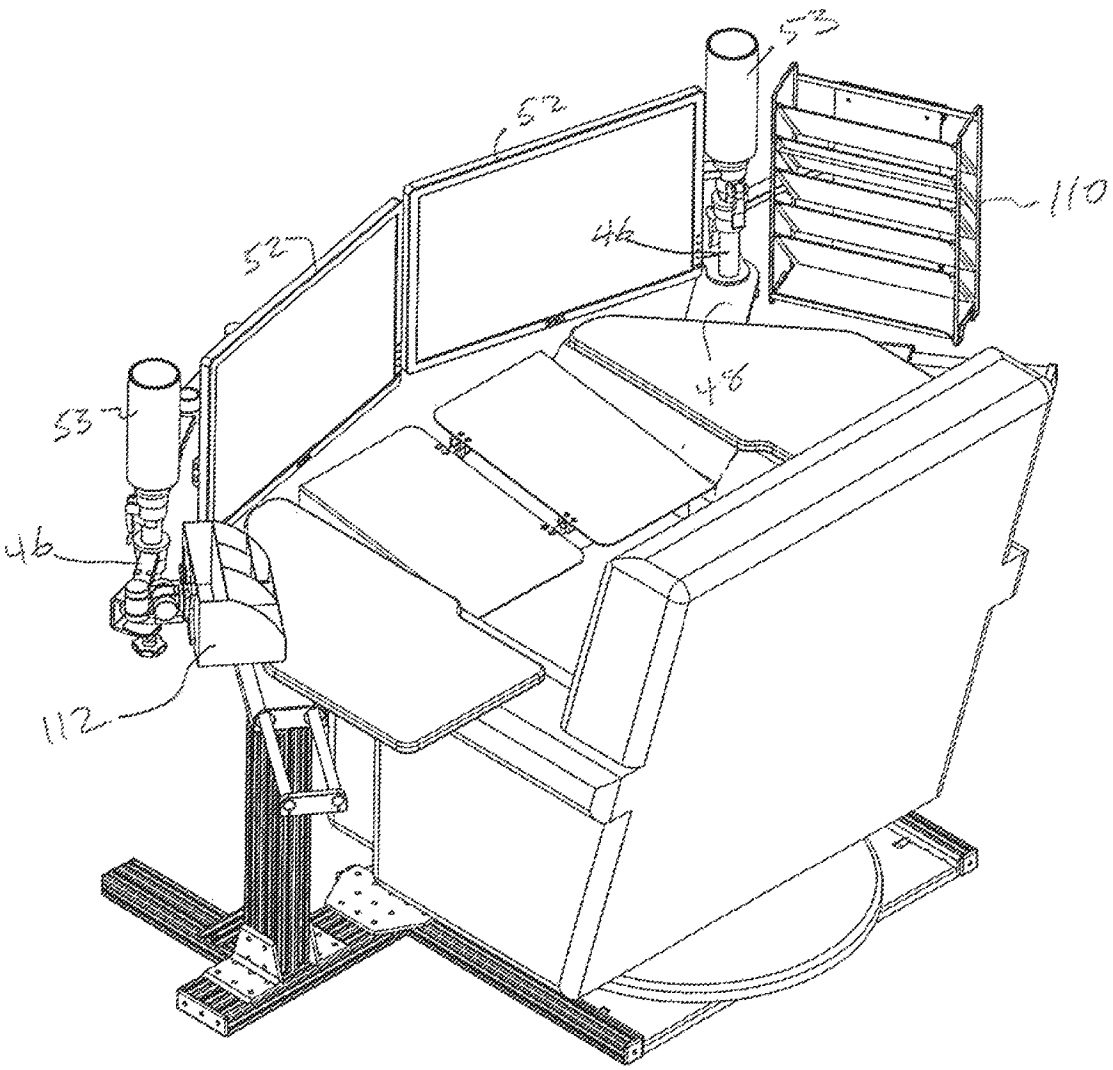
FIG. 15 is an isometric view from the top back left of the desk of the invention similar to that of FIG. 2, but from a slightly different angle and showing several optional accessories mounted on the desk.

FIG. 15 shows a view similar to that of FIG. 2, but at a slightly different angle, with the respective desk surfaces in use position. FIG. 15 shows how various accessories can be added to the desk and shows a paper or document holder 110 attached to one of the monitor mounts 46 and shows a supply holder 112 attached to the opposite monitor mount. These show examples of various accessories that can be added to the desk in various ways.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A desk having a front of the desk and having a back of the desk at which a user sits in a selected chair to work at the desk, comprising:

a base;

a first support mounted to the base;

a second support mounted to the base and spaced from the first support a distance to allow a front portion of the selected chair when adjacent the back of the desk to be accessed between the first support and the second support;

a first desk surface mounted on the first support;

a second desk surface mounted on the second support;

said first desk surface mounted on the first support to be movable between a first desk surface access position and a first desk surface use position wherein when the first desk surface is in said first desk surface access position, an opening is formed from the front of the desk between the first desk surface and the second desk surface to the front portion of the selected chair through which the user can access the front portion of the selected chair from the front of the desk and when in first desk surface use position at least a portion of the first desk surface extends across a front portion of the selected chair in front of a user when seated in the selected chair so the first desk surface can be used as a desk surface by a user siting in the selected chair.

2. A desk according to claim 1, wherein the second desk surface is also movable between a second desk surface access position and a second desk surface use position.

3. A desk according to claim 2, wherein the first desk surface includes a first desk surface confronting edge and the second desk surface includes a second desk surface confronting edge, said first desk surface confronting edge and said second desk surface confronting edge configured to confront one another when said first desk surface is in said first desk surface use position and said second desk surface is in said second desk surface use position.

4. A desk according to claim 1, additionally including a computer monitor mount mounted to at least one of the first and second supports.

5. A desk according to claim 1, wherein the first desk surface is mounted to the first support to allow rotational and back and forth lateral movement with respect to the first support and the second desk surface is mounted to the second support to allow rotational and back and forth lateral movement with respect to the second support.

6. A desk according to claim 1, additionally including a chair contact extending from the first desk surface to interface with a chair when a chair is positioned to be accessed between the first support and the second support and the first desk surface is in the first desk surface use position.

7. A desk comprising:

a base;

a first support mounted to the base;

a second support mounted to the base and spaced from the first support a distance to allow a front portion of a selected chair to be accessed between the first support and the second support;

a first desk surface mounted on the first support, said first desk surface movable between a first desk surface access position and a first desk surface use position; and a second desk surface mounted on the second support, said second desk surface movable between a second desk surface access position and a second desk surface use position;

wherein the first desk surface includes a first desk surface confronting edge and the second desk surface includes a second desk surface confronting edge, said first, desk surface confronting edge and said second desk surface confronting edge configured to confront one another when said first desk surface is in said first desk surface use position and said second desk surface is in said second desk surface use position; and additionally including an attachment device to attach said first desk surface confronting edge to said second desk surface confronting edge when said first desk surface is in said first desk surface use position and said second desk surface is in said second desk surface use position.

8. A desk according to claim 7, wherein the first desk surface is mounted to allow rotational and back and forth lateral movement with respect to the base and the second desk surface is mounted to allow rotational and back and forth lateral movement with respect to the base.

9. A desk according to claim 8, additionally including a chair contact extending from the first desk surface to interface with a chair when a chair is positioned to be accessed between the first support and the second support and the first desk surface is in the first desk surface use position.

10. A desk according to claim 9, wherein the chair contact comprises a bracket extending downwardly from the first desk surface configured to abut an arm of a chair when a chair having an arm is positioned to be accessed between the first support and the second support.

11. A desk according to claim 10, additionally including a chair contact extending from the second desk surface to interface with a chair when a chair is positioned to be accessed between the first support and the second support and the second desk surface is in the second desk surface use position.

12. A desk according to claim 7, wherein the first desk surface is mounted to the first support to allow rotational and back and forth lateral movement with respect to the first support and the second desk surface is mounted to the second support to allow rotational and back and forth lateral movement with respect to the second support.

13. A desk having a front of the desk and having a back of the desk at which a user sits in a selected chair to work at the desk, comprising:

a base;

a first support mounted to the base;

a second support mounted to the base and spaced from the first support a distance to allow a front portion of the selected chair when adjacent the back of the desk to be accessed between the first support and the second support;

a first desk surface mounted on the first support;

a second desk surface mounted on the second support;

said first desk surface mounted on the first support to be movable between a first desk surface access position first desk surface use position wherein when the first desk surface is in said first desk surface access position, an opening is formed from the front of the desk between the first desk surface and the second desk surface to the front portion of the selected chair through which the user can access the front portion of the selected chair from the front of the desk and when in first desk surface use position at least a portion of the first desk surface extends across a front portion of the selected chair in front of a user when seated in the selected chair so the first desk surface can be used as a desk surface by a user siting in the selected chair;

a first rotation shaft extending from the first support and mounted for rotation with respect to the first support about a substantially vertical axis; and a first mounting arm connected to the first rotation shaft, said first desk surface connected to said first mounting arm.

14. A desk according to claim 13, wherein the connection of the first mounting arm to the first rotation shaft allows lateral movement of the first mounting arm with respect to the first rotation shaft.

15. A desk according to claim 14, wherein the first desk surface is rotatably connected to the first mounting arm.

16. A desk according to claim 15, wherein the connection of the first mounting arm to the first rotation shaft includes a first linear bearing housing attached to the first rotation shaft, said first linear bearing housing having at least one first linear shaft extending therethrough and movable linearly with respect thereto, said first mounting arm secured to the at least one first linear shaft and movable therewith.

17. A desk according to claim 16, wherein the second desk surface is movable while mounted on said second support between a second desk surface access position and a second desk surface use position;

additionally including a second rotation shaft extending from the second support and mounted for rotation with respect to the second support about a substantially vertical axis; and a second mounting arm connected to the second rotation shaft, said second desk surface connected to said second mounting arm.

18. A desk according to claim 17, wherein the connection of the second mounting arm to the second rotation shaft allows lateral movement of the mounting arm with respect to the second rotation shaft; and wherein the second desk surface is rotatably connected to the second mounting arm.

19. A desk according to claim 18, wherein the connection of the second mounting arm to the second rotation shaft includes a second linear bearing housing attached to the second rotation shaft, said second linear bearing housing having at least one second linear shaft extending therethrough and movable linearly with respect thereto, said second mounting arm secured to the at least one second linear shaft and movable therewith.

20. A desk according to claim 19, wherein an adjustable computer monitor mount is attached to each of the first and second mounting arms.

* * * * *